US009397405B2

(12) United States Patent
Yanagi et al.

(10) Patent No.: US 9,397,405 B2
(45) Date of Patent: Jul. 19, 2016

(54) ANTENNA DEVICE

(75) Inventors: Masahiro Yanagi, Tokyo (JP); Shigemi Kurashima, Tokyo (JP); Hideaki Yoda, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 156 days.

(21) Appl. No.: 13/329,452

(22) Filed: Dec. 19, 2011

(65) Prior Publication Data

US 2012/0162036 A1 Jun. 28, 2012

(30) Foreign Application Priority Data

Dec. 28, 2010 (JP) ..... 2010-294268

(51) Int. Cl.

| | |
|---|---|
| ***H01Q 9/42*** | (2006.01) |
| ***H01Q 13/10*** | (2006.01) |
| ***H01Q 5/00*** | (2015.01) |
| ***H01Q 5/378*** | (2015.01) |

(52) U.S. Cl.
CPC ..... *H01Q 9/42* (2013.01); *H01Q 5/378* (2015.01); *H01Q 13/10* (2013.01)

(58) Field of Classification Search
CPC ..... H01Q 1/38; H01Q 1/48; H01Q 1/243; H01Q 5/378; H01Q 19/005
USPC ..... 343/702, 767, 833, 834, 846, 700 MS, 343/848
See application file for complete search history.

(56) References Cited

U.S. PATENT DOCUMENTS

| | | | | |
|---|---|---|---|---|
| 5,966,097 | A | 10/1999 | Fukasawa et al. | |
| 7,030,830 | B2 * | 4/2006 | Azoulay et al. | 343/815 |
| 7,215,289 | B2 * | 5/2007 | Harano | 343/702 |
| 7,248,220 | B2 * | 7/2007 | Futamata | 343/700 MS |
| 7,256,743 | B2 * | 8/2007 | Korva | 343/702 |
| 7,319,432 | B2 * | 1/2008 | Andersson | 343/702 |
| 8,125,392 | B2 | 2/2012 | Furuya et al. | |
| 2003/0112195 | A1 * | 6/2003 | Cheng et al. | 343/767 |
| 2005/0110692 | A1 * | 5/2005 | Andersson | 343/702 |
| 2007/0046465 | A1 | 3/2007 | Sakama et al. | |
| 2008/0284670 | A1 * | 11/2008 | Kanno et al. | 343/767 |
| 2009/0153407 | A1 * | 6/2009 | Zhang et al. | 343/702 |
| 2009/0273524 | A1 * | 11/2009 | Furuya et al. | 343/700 MS |
| 2010/0123640 | A1 * | 5/2010 | Hui et al. | 343/848 |
| 2010/0182202 | A1 * | 7/2010 | Shih | H01Q 9/42 343/700 MS |
| 2010/0214175 | A1 * | 8/2010 | Hui et al. | 343/700 MS |
| 2010/0238072 | A1 * | 9/2010 | Ayatollahi et al. | 343/700 MS |

FOREIGN PATENT DOCUMENTS

| | | |
|---|---|---|
| JP | H09-326632 | 12/1997 |
| JP | 2003-101326 | 4/2003 |
| JP | 2007-060386 | 3/2007 |
| JP | 2007-166297 | 6/2007 |
| JP | 2009-218878 | 9/2009 |
| WO | WO2008/026587 | 3/2008 |

* cited by examiner

*Primary Examiner* — Hoang V Nguyen
*Assistant Examiner* — Daniel J Munoz
(74) *Attorney, Agent, or Firm* — IPUSA, PLLC

(57) ABSTRACT

An antenna device includes a ground element configured to be grounded, a first antenna to be connected to a radio communication module, and a second antenna configured to be parasitic on the first antenna, the second antenna receiving no power feed.

5 Claims, 7 Drawing Sheets

ANTENNA DEVICE

CROSS-REFERENCE TO RELATED APPLICATIONS

This patent application is based upon and claims the benefit of priority of Japanese Patent Application No. 2010-294268 filed on Dec. 28, 2010, the entire contents of which are incorporated herein by reference.

BACKGROUND OF THE INVENTION

1. Field of the Invention

The present invention generally relates to an antenna device.

2. Description of the Related Art

An example of an antenna device of a monopole type is used for data communication in a small-sized electronic communication apparatus such as a personal computer, a mobile phone and an audiovisual apparatus because the length of an antenna element of a monopole-type antenna is about one fourth (¼) of the wavelength λ of a using frequency.

An antenna device which performs high-capacity communication is used for BLUETOOTH (BLUETOOTH is a registered trademark) in a 2.4 GHz band which is standardized as IEEE 802.15.1, a wireless Local Area Network (LAN) which is standardized as IEEE 802.11, and so on.

Along with recent increases of communication information amount, Patent Documents 1 and 2 provide antennas for attaining miniaturization and a broadband property.

A sufficient radiant gain (antenna gain) is not obtainable if the monopole type antenna device is merely miniaturized.

The object of the present invention is to provide an antenna device in which the miniaturization and the increase of the radiant gain are achieved.

[Patent Document 1] Japanese Laid-open Patent Publication No. 2007-060386

[Patent Document 2] Japanese Laid-open Patent Publication No. 2003-101326

SUMMARY OF THE INVENTION

Accordingly, embodiments of the present invention may provide a novel and useful antenna device solving one or more of the problems discussed above.

More specifically, the embodiments of the present invention may provide an antenna device including a ground element configured to be grounded; a first antenna to be connected to a radio communication module; and a second antenna configured to be parasitic on the first antenna, the second antenna receiving no power feed.

Another aspect of the present invention may be to provide an antenna device, wherein the first antenna is a first antenna element including a power feeding point receiving power feed from the radio communication module positioned in the vicinity of the ground element, and the second antenna is a second antenna element connected to the ground element.

Another aspect of the present invention may be to provide an antenna device, wherein the first antenna is a slot formed in the ground element, and the second antenna is a second antenna element connected to the ground element.

Another aspect of the present invention may be to provide an antenna device, wherein the first antenna and the second element have corresponding portions shaped like elongated rectangles and arranged parallel to each other.

Additional objects and advantages of the embodiments are set forth in part in the description which follows, and in part will become obvious from the description, or may be learned by practice of the invention. The objects and advantages of the invention will be realized and attained by means of the elements and combinations particularly pointed out in the appended claims. It is to be understood that both the foregoing general description and the following detailed description are exemplary and explanatory and are not restrictive of the invention as claimed.

DETAILED DESCRIPTION OF THE PREFERRED EMBODIMENTS

A description is given below, with reference to the FIG. 1 through FIG. 9 of embodiments of the present invention.

First Embodiment

Figure 1:
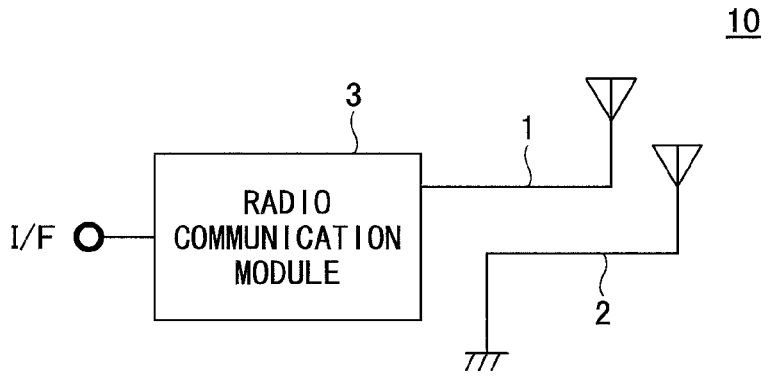
FIG. 1 schematically illustrates an exemplary circuit configuration of an antenna device of a first embodiment.

FIG. 1 schematically illustrates an exemplary circuit configuration of an antenna device of the first embodiment.

The antenna device 10 of the first embodiment is a dipole antenna including an antenna 1, an antenna 2, and a radio communication module 3.

The antenna 1 is connected to the radio communication module 3 and receives power from the radio communication module 3.

The antenna 2 is grounded and arranged in the vicinity of the antenna 1. The antenna 2 is a parasitic antenna of the antenna 1 which is parasitic on the antenna 1 without power feeding.

Figure 2:
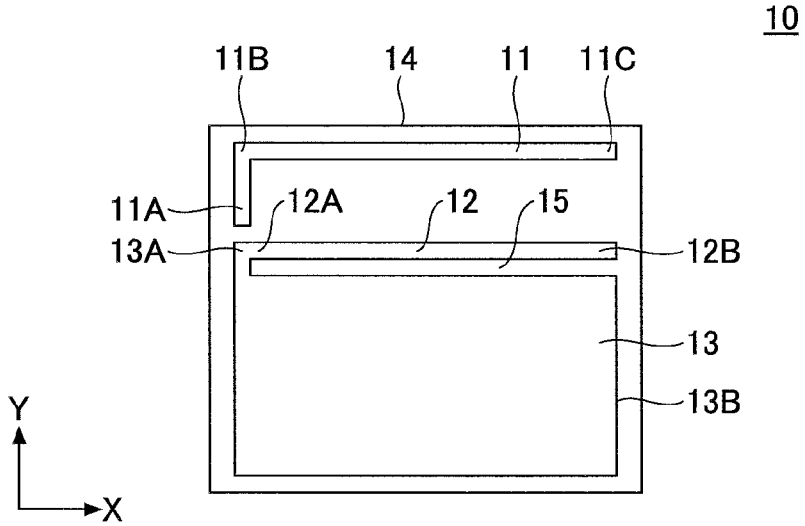
FIG. 2 is a plan view of the antenna device of the first embodiment.

FIG. 2 is a plan view of the antenna device 10 of the first embodiment. Referring to FIG. 2, the X axis is arranged in the lateral direction (the rightward direction is positive) and the Y axis is arranged in the longitudinal direction (the upward direction is positive).

The antenna device 10 includes an antenna element 11, an antenna element 12, a ground element 13 and a board 14.

The antenna element 11, the antenna element 12 and the ground element 13 are planar members formed on a surface of the board 14. For example, by patterning a copper foil formed on the surface of the board 14, the antenna element 11, the antenna element 12 and the ground element 13 are formed. The board 14 may be a FR4 board made of glass epoxy or a flexible board made of polyimide.

The antenna element 11 is shaped like the letter "L" in its plan view (e.g., an inverted-L antenna) and includes a power feeding point 11A at an end close to the ground element 13. The antenna element 11 extends in the positive direction in parallel with the Y axis from the power feeding point 11A and is bent at a bent portion 11B in the positive direction in parallel with the X axis and extends to reach an end portion 11C. The length of the antenna element 11 from the power feeding point 11A to the end portion 11C may be one fourth of a wavelength λ (λ/4) of a used frequency.

The antenna element 12 is shaped like a straight line (an elongated rectangle) in its plan view. A first end 12A of the antenna element 12 is connected in the vicinity of the left vertex of the ground element 13 in a substantially rectangular shape 12 and extends in the positive direction in parallel with the X axis.

Referring to FIG. 2, the ground element 13 is substantially rectangular in its plan view and includes a grounding portion 13A at around the left vertex to which the antenna element 12 is to be connected. The position of the grounding portion 13A is the same as that of the first end 12A of the antenna element 12.

The antenna element 12 and the ground element 13 are made by forming a slit 15 in a copper foil having a rectangular shape.

The X coordinate position (the X coordinate value) of the end portion 11C of the antenna element 11, the X coordinate position (the X coordinate value) of a second end 12B of the antenna element 12, and X coordinate position (the X coordinate value) of a right side 13B of the ground element 13 are the same.

A part of the antenna element 11 between the bent portion 11B and the end portion 11C is arranged in parallel with the antenna element 12. The antenna element 12 is arranged close to the antenna element 11 so that antenna element 12 can be parasitic on the antenna element 11.

For example, the dimensions of the antenna device 10 are as follows. A distance between the bent portion 11B of the antenna element 1 and the end portion 11C is 19 mm. A distance between the power feeding point 11A and the bent portion 11B is 5 mm. A distance between the power feeding point 11A and the grounding portion 13A is 1 mm. The width of the slit 15 in the Y direction is 1 mm. The length of the slit 15 in the X direction is 18 mm. A distance between a first end 12A and a second end 12B in the antenna element 1 is 18 mm. The length of the ground element 13 in the X direction is 19 mm. The length of the ground element 13 in the Y direction is 24 mm.

In the antenna device 10 illustrated in FIG. 2, a core wire of a coaxial cable (not illustrated) is connected to the power feeding point 11A, and a shield wire of the coaxial cable is connected to the grounding portion 13A. The other end of the coaxial cable is connected to the radio communication module 3 illustrated in FIG. 1 so that the antenna element receives power.

Referring to FIG. 1, the antenna element 11 receives power from the radio communication module 3 and the antenna element 12 does not receive power. However, the antenna element 12 is parasitic on the antenna element 11.

Therefore, the antenna element 11 illustrated in FIG. 2 functions as the antenna 1 illustrated in FIG. 1, and the antenna element 12 illustrated in FIG. 2 functions as the antenna 2 illustrated in FIG. 1.

Therefore, the antenna device 10 illustrated in FIG. 2 functions as a bipolar-type antenna device having the circuit configuration as illustrated in FIG. 1.

Figure 3:
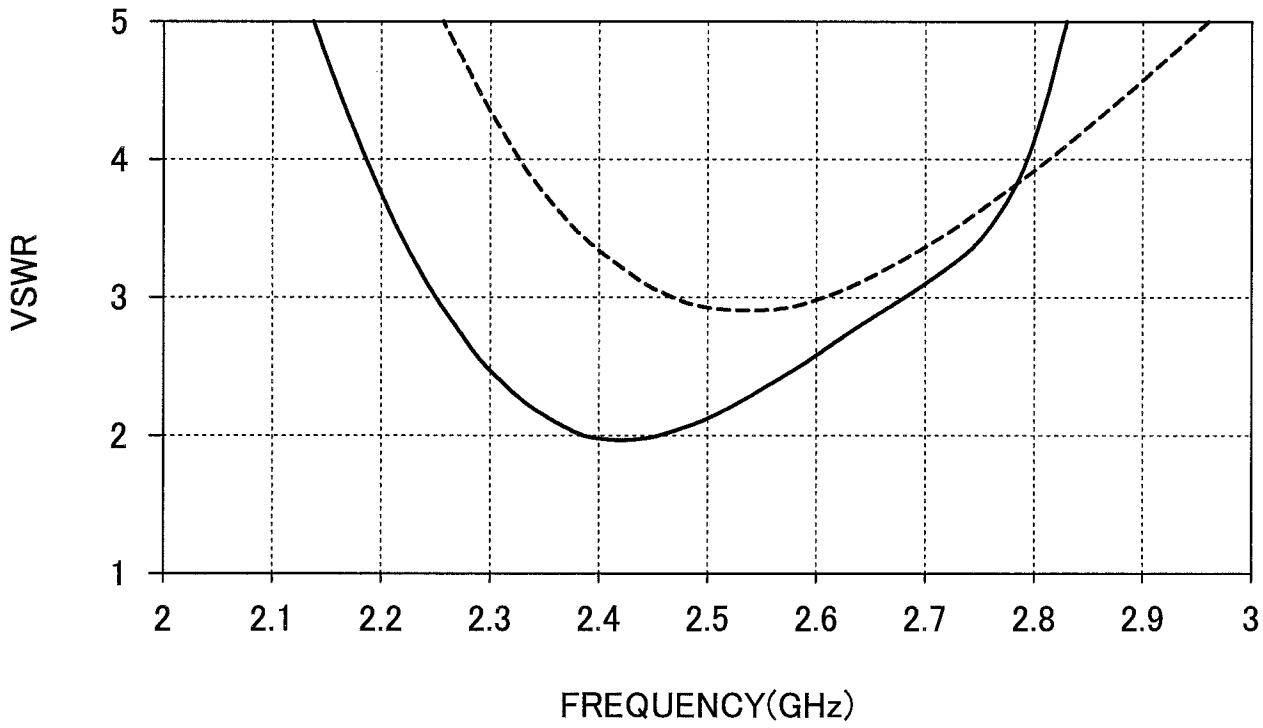
FIG. 3 illustrates a voltage standing wave ratio (VSWR) of a frequency characteristic of the antenna device of the first embodiment and an antenna device for comparison.

FIG. 3 illustrates a voltage standing wave ratio (VSWR) of a frequency characteristic of the antenna device of the first embodiment and an antenna device for comparison. Referring to FIG. 3, the solid line indicates a VSWR characteristic of the antenna device 10 of the first embodiment and the broken line indicates a VSWR characteristic of the antenna device for comparison.

The antenna device for comparison does not have the slit 15. Said differently, the antenna device for comparison is a monopole type antenna which does not include the antenna element 12 and the ground element 13 extends over the antenna element 12 and the slit 15.

Referring to FIG. 3, in the antenna device for comparison, the VSWR is about 3.3 in 2.4 GHz and about 2.8 in 2.5 GHz.

In comparison, in the antenna device 10 of the first embodiment, the VSWR is about 2.0 in 2.4 to 2.5 GHz and 2.0 or smaller in 2.45 GHz.

Further, in the antenna device 10 of the first embodiment, the frequency band where the value of the VSWR becomes 3.0 or smaller is about 2.25 to 2.68 GHz. Thus, the VSWR of the antenna device 10 of the first embodiment becomes good in a range wider than that in the antenna device for comparison.

As described, the antenna device 10 illustrated in FIG. 2 has radiant characteristics much better than the monopole-type antenna device for comparison because the antenna device 10 includes the antenna element 12 which is parasitic on the antenna element 11 without feeding power to the antenna element 12.

Further, the antenna element 12 is provided in the antenna device 10 illustrated in FIG. 2 by forming only the slit 15. Therefore, the antenna device 10 can be miniaturized.

As described, with the first embodiment, it is possible to provide the antenna device 10 which is miniaturized and has an increased radiant gain.

Figure 4:
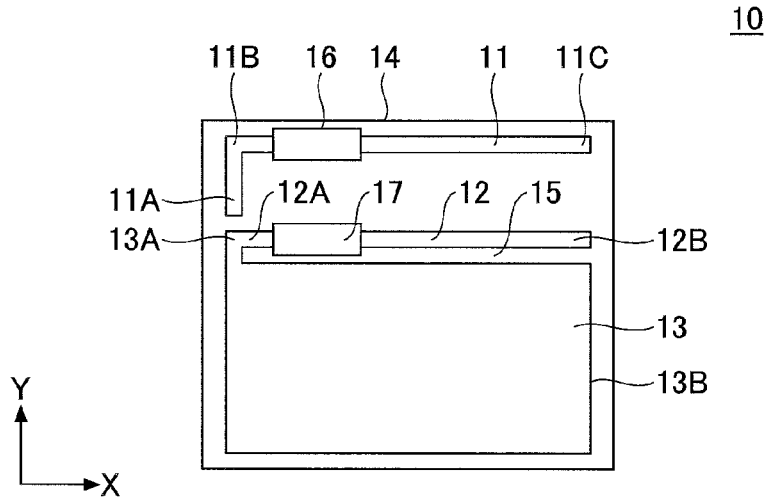
FIG. 4 is a plan view of a modified example of the antenna device of the first embodiment.

As illustrated in FIG. 4, matching elements 16 and 17 may be provided (inserted) in the antenna elements 11 and 12, respectively. The matching elements 16 and 17 are a coil, a capacitor, or a coil and a capacitor. The inductance or the capacitance (the electrostatic capacitance) may be appropriately set so as to attain appropriate matching of the antenna elements 11 and 12. By providing (inserting) the matching elements 16 and 17, the lengths of the antenna elements 11 and 12 are shortened and the antenna device 10 may further be miniaturized.

Second Embodiment

Figure 5:
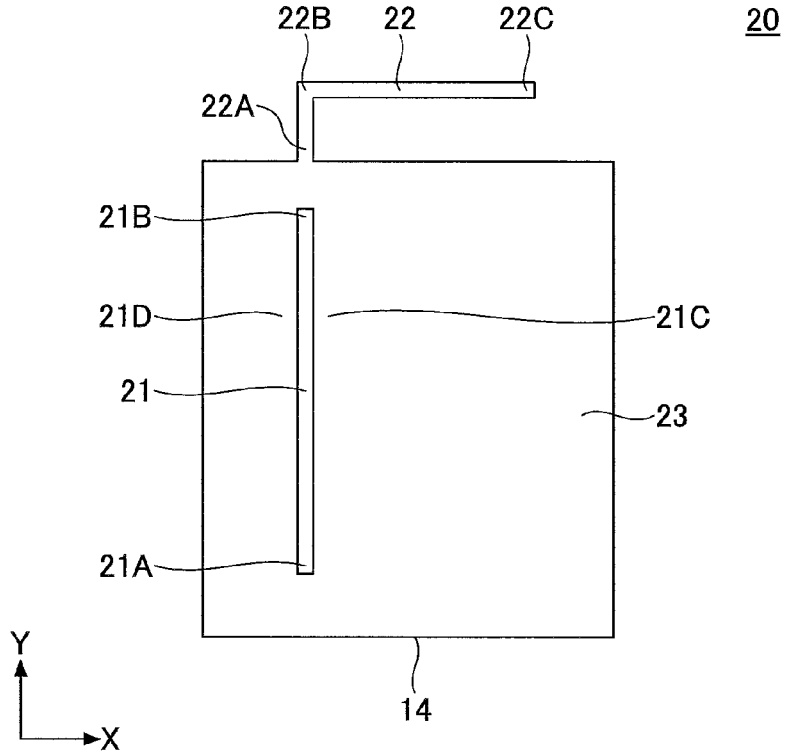
FIG. 5 is a plan view of an antenna device of a second embodiment.

FIG. 5 is a plan view of the antenna device of the second embodiment. Referring to FIG. 5, the X axis is arranged in the lateral direction (the rightward direction is positive) and the Y axis is arranged in the longitudinal direction (the upward direction is positive).

The antenna device 20 of the Second Embodiment includes the antenna element 21, an antenna element 22, a ground element 23 and a board 14.

The antenna element 21, the antenna element 22 and the ground element 23 are planar members formed on a surface of the board 14. For example, by patterning a copper foil formed on the surface of the board 14, the antenna element 21, the antenna element 22 and the ground element 23 are formed. The board 14 may be a FR4 board made of glass epoxy or a flexible board made of polyimide in a similar manner to the Second Embodiment.

The antenna element 21 is a slot antenna shaped like a straight line (a vertically elongated rectangle) in its plan view and is formed by an opening in a shape of a straight line (a vertically elongated rectangle) in the ground element 23.

The length of the antenna element 21 between a third end 21A and a fourth end 21B is a half (λ/2) of a used wavelength λ.

Electricity is fed into the antenna element 21 on one side of the antenna element 21 in the longitudinal direction. The other side of the antenna element 21 is grounded. Hereinafter, the reference symbol of a power feeding point is 21C and the reference symbol of a grounding portion is 21D.

The antenna element 22 is shaped like the letter "L" in its plan view (e.g., an inverted-L antenna). One end of the antenna element is connected to the ground element 23. The antenna element 22 extends in the positive direction in parallel with the Y axis from a fifth end 22A, is bent at a bent portion 22B in the positive direction in parallel with the X axis, and extends to reach an end portion 22C. The length of the antenna element 22 from the fifth end 22A to the end portion 22C may be one fourth (λ/4) of the wavelength λ of the used frequency.

The ground element 23 is substantially shaped like a rectangular in its plan view and grounded at the grounding portion 21D.

The X coordinate positions (the X coordinate values) of the fifth end 22A of the antenna element 22 partly or fully overlaps the X coordinate positions (the X coordinate values) of the antenna element 21.

The antenna element 22 is arranged close to the antenna element 21 so that antenna element 22 can be parasitic on the antenna element 21.

In the antenna device 20 illustrated in FIG. 5, a core wire of a coaxial cable (not illustrated) is connected to the power feeding point 21C, and a shield wire of the coaxial cable is connected to the grounding portion 21D. The other end of the coaxial cable is connected to the radio communication module 3 illustrated in FIG. 1 so that the antenna element 21 receives power.

The antenna element 21 receives power from the radio communication module 3 (see FIG. 1). The antenna element 22 does not receive power and is parasitic on the antenna element 21.

Therefore, the antenna element 21 illustrated in FIG. 5 performs the same function as that of the antenna 1 illustrated in FIG. 1, and the antenna element 22 illustrated in FIG. 5 performs the same function as that of the antenna 2 illustrated in FIG. 1.

Therefore, the antenna device 20 illustrated in FIG. 5 performs the same function as that of the bipolar-type antenna device 10 having the circuit configuration as illustrated in FIG. 1.

Figure 6:
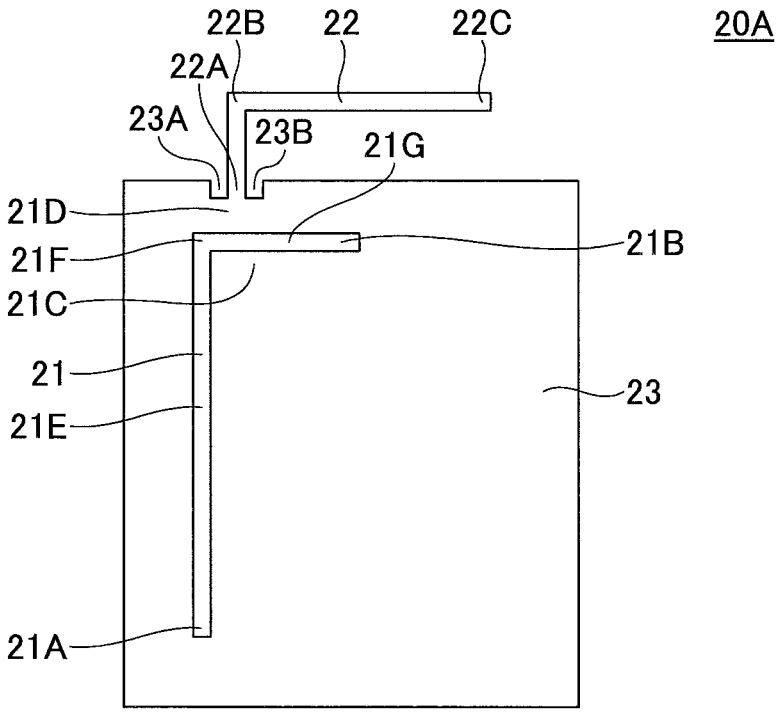
FIG. 6 is a plan view of a modified example of the antenna device of the second embodiment.

Referring to FIG. 6, the antenna device of a modified example of the Second Embodiment is described.

FIG. 6 is a plan view of the modified example of the antenna device of the second embodiment.

The antenna device 20A of the modified example of the second embodiment differs from the antenna device 20 of the second embodiment in that the antenna element 21 is shaped like a reversed letter "L" (e.g., an inverted-L antenna), and the X coordinate positions (the X coordinate values) of the fifth end 22A of the antenna element 22 does not overlap the X coordinate positions (the X coordinate values) of the first end 21E of the antenna element 21 extending along the Y axis.

The antenna element 21 extends in the positive direction in parallel with the Y axis from the third end 21A, is bent at a bent portion 21F in the positive direction in parallel with the X axis, and extends to reach the fourth end 21B. There are provided a first portion 21E between the third end 21A and the bent portion 21F and a second portion 21G between the bent portion 21F and the fourth end 21B. The antenna element 21 is a slot antenna shaped like the reversed letter "L" (e.g., an inverted-L antenna) including the first portion 21E and the second portion 21G.

The ground element 23 has recesses 23A and 23B on both sides of the fifth end 22A of the antenna element 22 for adjusting the radiation characteristics of the antenna device 20A.

The grounding portion 21D is positioned on the ground element 23 between the fifth end 22A of the antenna element 22 and the antenna element 21.

The power feeding point 21C is positioned on a side opposite to the grounding portion 21D over the antenna element 21 being the slot antenna.

By forming the antenna element to be shaped like the letter "L" (e.g., an inverted-L antenna), a part parallel to a part (the second portion 21G) between the bent portion 22B and the end portion 22C of the antenna element 22, the antenna element 21 is strongly coupled to the antenna element 22 to thereby effectively excite the antenna element 22.

Figure 7:
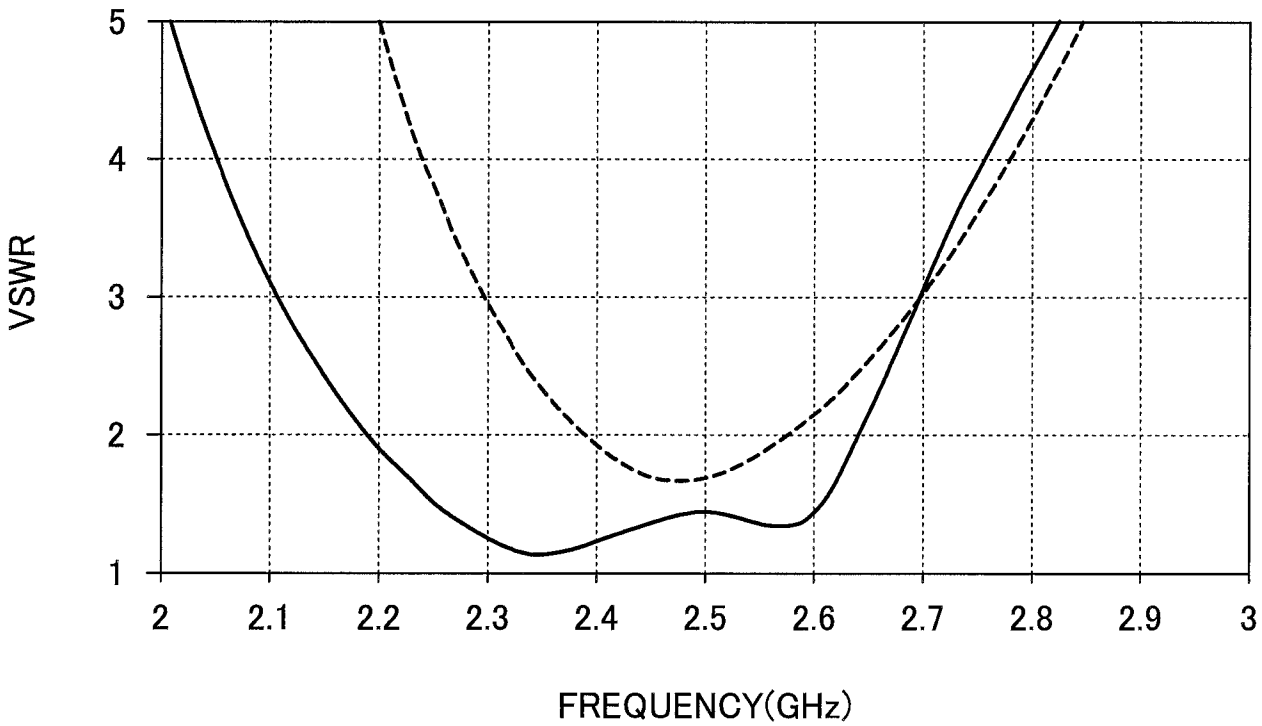
FIG. 7 illustrates a voltage standing wave ratio (VSWR) of a frequency characteristic of the antenna device of the second embodiment and an antenna device for comparison.

FIG. 7 illustrates a voltage standing wave ratio (VSWR) of a frequency characteristic of the antenna device of a modified example of the second embodiment and an antenna device for comparison. Referring to FIG. 7, the solid line indicates a VSWR characteristic of the antenna device 20 of the modified example of the second embodiment and the broken line indicates a VSWR characteristic of the antenna device for comparison.

The antenna device for comparison does not have the antenna element 22. Said differently, the antenna for comparison is a monopole type antenna device in which only the antenna element 21 functions as the antenna element.

Referring to FIG. 7, in the antenna device for comparison, the VSWR is about 1.9 in 2.4 GHz and about 1.7 in 2.5 GHz. This VSWR characteristic is obtained only in a narrow range of the bands.

On the contrary, the VSWR in the antenna device 20A of the modified example of the second embodiment is about 1.3 to about 1.4 in the bands of 2.4 GHz to 2.5 GHz. The VSWR is about 1.2 in 2.35 GHz.

Further, in the antenna device 20A of the modified example of the second embodiment, the frequency band where the value of the VSWR becomes 2.0 or smaller is about 2.2 to about 2.65 GHz. Thus, the VSWR of the antenna device 10 of the modified example of the second embodiment becomes good in a range wider than that in the antenna device for comparison.

Figure 8:
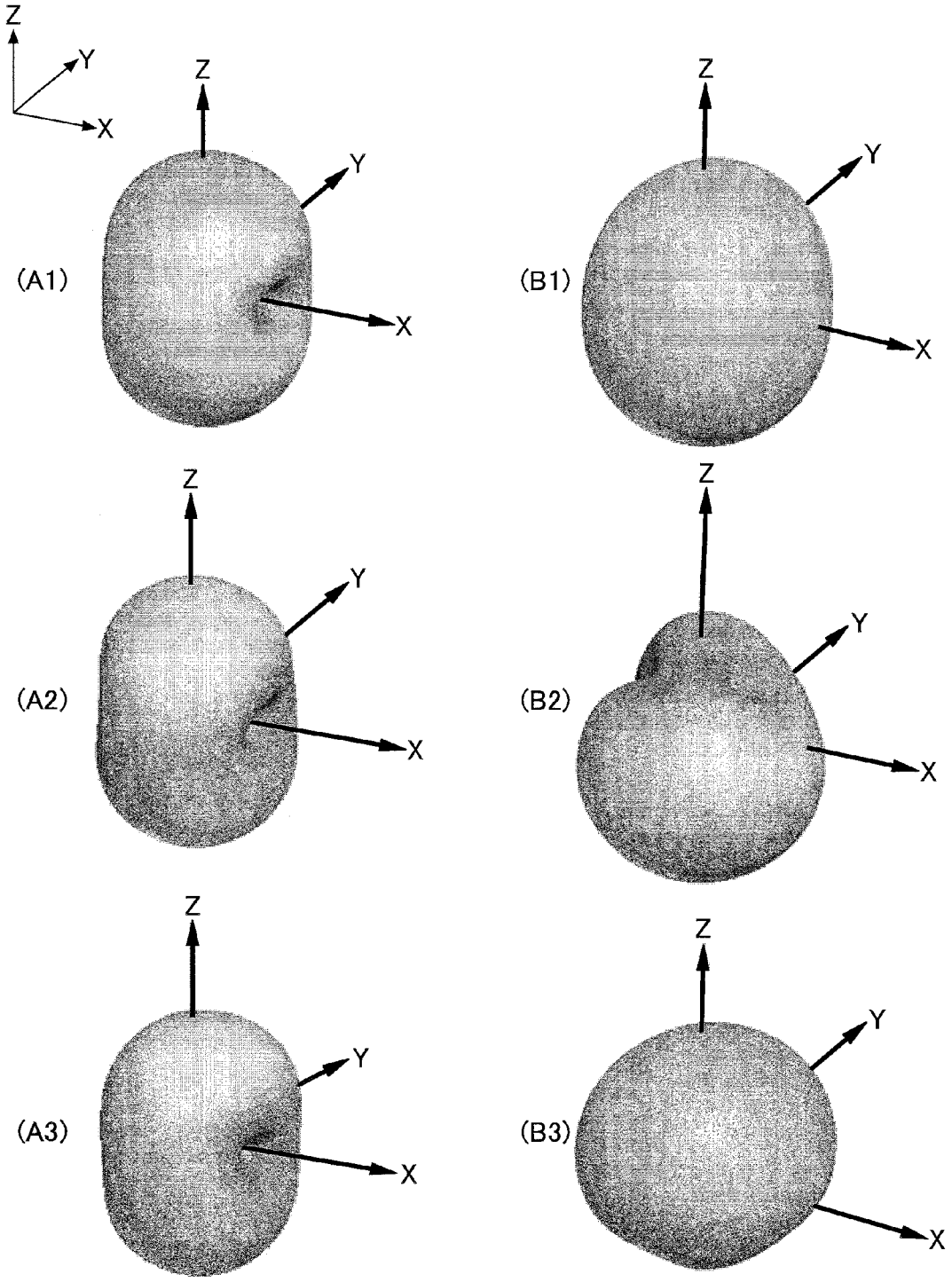
FIG. 8 illustrates directivity characteristics of the modified example of the antenna device of the second embodiment and the antenna device for comparison.

FIG. 8 illustrates directivity characteristics of the modified example of the antenna device of the second embodiment and the antenna device for comparison. The directivity characteristics of the antenna device for comparison are illustrated in (A1) to (A3) of FIG. 8. The directivity characteristic (A1) is obtained by adding a vertically-polarized wave, a horizontally-polarized wave, and a circularly-polarized wave. The directivity characteristic (A2) corresponds to a right-handed circularly polarized wave. The directivity characteristic (A3) corresponds to a left-handed circularly polarized wave. The directivity characteristics of the antenna device 20A of the modified example of the second embodiment are illustrated in (B1) to (B3) of FIG. 8. The directivity characteristic (B1) is obtained by adding a vertically-polarized wave, a horizontally-polarized wave, and a circularly-polarized wave. The directivity characteristic (B2) corresponds to a right-handed circularly polarized wave. The directivity characteristic (B3) corresponds to a left-handed circularly polarized wave.

The directivity characteristic (A1) obtained by adding the vertically-polarized wave, the horizontally-polarized wave, and the circularly-polarized wave in the antenna device for comparison is +3.5 dB (the maximum value). The directivity characteristic (B1) obtained by adding the vertically-polarized wave, the horizontally-polarized wave, and the circularly-polarized wave in the antenna device 20A of the modified example of the second embodiment is +2.7 dB (the maximum value). Thus, the antenna device 20A of the modified example of the second embodiment shows the directivity characteristic slightly smaller than that of the antenna device for comparison. However, the value +2.7 dB (the maximum value) in the antenna device 20A of the modified example of the second embodiment is preferable.

The directivity characteristic (A1) corresponding to the right-handed circularly polarized wave in the antenna device for comparison is +0.8 dB (the maximum value). The directivity characteristic (B1) corresponding to the right-handed circularly polarized wave in the antenna device 20A of the modified example of the second embodiment is +2.7 dB (the maximum value). Thus, the antenna device 20A of the modified example of the second embodiment shows the directivity characteristic much greater than that of the antenna device for comparison. The reason for this is supposed that the radiation characteristics of the antenna device 20A are improved by providing the antenna element 22 to which power is not fed.

The directivity characteristic (A3) corresponding to the left-handed circularly polarized wave in the antenna device for comparison is +0.8 dB (the maximum value). The directivity characteristic (B3) corresponding to the left-handed circularly polarized wave in the antenna device 20A of the modified example of the second embodiment is +2.7 dB (the maximum value). Thus, the antenna device 20A of the modified example of the second embodiment shows the directivity characteristic much greater than that of the antenna device for comparison. The reason for this is believed to be that the radiation characteristics of the antenna device 20A are improved by providing the antenna element 22 to which power is not fed.

The frequency characteristics of VSWR and the directivity characteristics in the antenna device 20A (see FIG. 6) of the modified example of the second embodiment are illustrated in FIG. 7 and FIG. 8. The similar frequency characteristics of VSWR and the directivity characteristics to those in the antenna device 20A is obtainable in the antenna device 20 of the second embodiment.

As described, the antenna device 20 of the second embodiment is believed to have radiant characteristics much better than the monopole-type antenna device for comparison because the antenna device 20 includes the antenna element 22 which is parasitic on the antenna element 21 without feeding power to the antenna element 22.

Because the antenna element 21 being the slot antenna and the antenna element 22 are included in the antenna device 20 of the second embodiment, the antenna device 20 can be miniaturized.

As described, with the second embodiment, it is possible to provide the antenna device 20 which is miniaturized and has an increased radiant gain.

Further, the matching element including a coil, a capacitor or a coil and a capacitor may be inserted in the antenna element 22. By providing (inserting) the matching element, the length of the antenna element 22 is shortened and the antenna device 20 may further be miniaturized.

Figure 9:
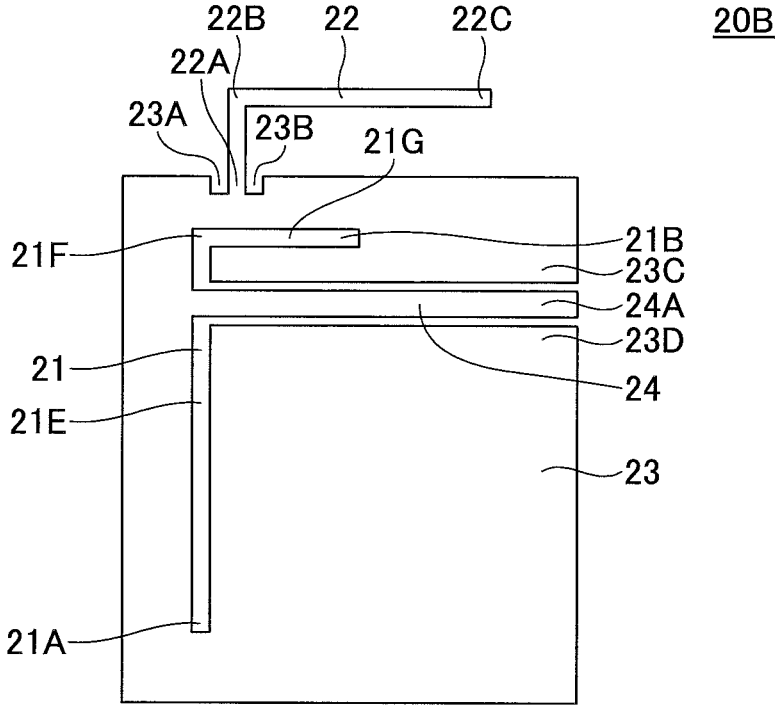
FIG. 9 is a plan view of a modified example of the antenna device of the first embodiment.

Referring to FIG. 9, a coplanar line may be formed to feed power to the antenna element 21. A coplanar line 24 connected to the power feeding point 21C illustrated in FIG. 6 is provided in the antenna device 20B illustrated in FIG. 9.

In the antenna device 20B illustrated in FIG. 9, a power feeding point 24A is positioned at the right end of the coplanar line 24, and grounding portions 23C and 23D are positioned in the ground element 23 on both sides of the power feeding point 24A in the vicinity of the power feeding point 24A. Only one of the grounding portions 23C and 23D may be used as the grounding portion.

As described in the embodiments, it is possible to provide the antenna devices which are miniaturized and have the increased radiant gains.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

What is claimed is:

1. An antenna device comprising:

a ground element configured to be grounded;

a first antenna including a power feeding point for receiving power feed, the first antenna being a closed end slot, which is formed in the ground element and all ends of which are closed within the ground element, and including a first slot extending linearly in a first direction; and a second antenna that is in an inverse-L shape and includes a first part connected to the ground element at one end of the first part, the first part extending in the first direction so as to separate from the ground element, and a second part extending from another end of the first part in a second direction perpendicular to the first direction, the second antenna being configured to be parasitic on the first antenna, the second antenna receiving no power feed, wherein a width of the first antenna along the second direction is the same as a width of the first part of the second antenna along the second direction, wherein the first slot of the first antenna and the first part of the second antenna are linearly arranged along one straight line in the first direction.

2. The antenna device according to claim 1, wherein the first antenna is shaped like a letter L, and includes a second slot that extends from the first slot in the second direction.

3. The antenna device according to claim 2, wherein the second slot of the first antenna is parallel to the second part of the second antenna.

4. The antenna device according to claim 1, wherein the ground element includes a recess on a side of the one end of the first part of the second antenna.

5. The antenna device according to claim 1, further comprising:

a coplanar line for supplying the power feed to the first antenna, the coplanar line being connected to the power feeding point.

* * * * *